US006672948B2

(12) United States Patent
Mizuno

(10) Patent No.: US 6,672,948 B2
(45) Date of Patent: Jan. 6, 2004

(54) GRINDING WATER TANK APPARATUS, AND EYEGLASS LENS MACHINING APPARATUS HAVING THE SAME

(75) Inventor: Toshiaki Mizuno, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 10/400,505

(22) Filed: Mar. 28, 2003

(65) Prior Publication Data

US 2003/0186629 A1 Oct. 2, 2003

(51) Int. Cl.[7] ..... B24B 1/00

(52) U.S. Cl. ..... 451/60; 451/36; 451/41; 451/42; 451/43; 451/44; 451/87; 451/88; 451/255; 451/256; 451/446

(58) Field of Search ..... 451/36, 41, 42, 451/43, 44, 60, 87, 88, 255, 256, 446

(56) References Cited

U.S. PATENT DOCUMENTS 5,376,268 A * 12/1994 Ikeda ..... 210/383
5,584,749 A * 12/1996 Mitsuhashi et al. ..... 451/285
6,572,460 B2 * 6/2003 Mizuno ..... 451/178
2002/0132568 A1 9/2002 Mizuno

FOREIGN PATENT DOCUMENTS

JP 11-320408 11/1999

* cited by examiner

*Primary Examiner*—Lee D. Wilson
*Assistant Examiner*—Shantese McDonald
(74) *Attorney, Agent, or Firm*—Sughrue Mion, PLLC

(57) ABSTRACT

A grinding water tank apparatus includes a tank for storing grinding water to be used for machining a peripheral edge of an eyeglass lens and recycles the grinding water stored in the tank by circulation. The apparatus further includes an air filter provided at a position in a space higher than the water surface of the grinding water in the tank, and a suction unit for drawing bubbles developing in the tank by way of the air filter.

11 Claims, 2 Drawing Sheets

GRINDING WATER TANK APPARATUS, AND EYEGLASS LENS MACHINING APPARATUS HAVING THE SAME

BACKGROUND OF THE INVENTION

The invention relates to an eyeglass lens machining apparatus for machining a peripheral edge of an eyeglass lens, and to a grinding water tank apparatus for storing grinding water to be used for circulation during machining of a lens.

In an apparatus for machining a peripheral edge of an eyeglass lens, grinding water is supplied during machining operation in order to cool a portion of a lens being machined and remove resultant waste (chippings). For supplying the grinding water, there is a method in which grinding water is circulated by pumping grinding water stored in a tank with a pump and supplying the thus-pumped grinding water to a machining apparatus main unit, and by retuning wastewater to the tank.

When a plastic lens is machined, bubbles develop in the waste (wastewater), and the bubbles are accumulated around an upper portion of the inside of the tank. If machining is continued further, the tank is filled with the bubbles, and the bubbles will spill over the tank or be accumulated in a machining chamber of the machining apparatus main unit. Conventionally, in order to prevent occurrence of these problems, an operation for replacing grinding water in the tank or an operation for cleaning the tank must be performed frequently, thereby involving consumption of much labor.

Installation of a pump for pumping and circulating grinding water outside of the tank requires a space for installation. In some situations, difficulty has been encountered in installing a tank having a large volume below the machining apparatus main unit. In some pieces of related-art machining apparatus, a submerged pump is disposed at the bottom of the tank. However, at the time of replacement of grinding water in the tank or at the time of operation for cleaning the tank, efforts for removing the pump are required.

SUMMARY OF THE INVENTION

The invention has been conceived to solve the related-art problem. A technical challenge to be met by the invention is to provide a grinding water tank apparatus which mitigates the labor required for replacing grinding water in the tank or cleaning the tank and which can facilitate a maintenance operation, as well as an eyeglass lens machining apparatus having the grinding water tank apparatus.

In order to solve the aforesaid object, the invention is characterized by having the following arrangement.

(1) A grinding water tank apparatus capable of recycling grinding water used for machining an eyeglass lens, comprising:

a tank in which the grinding water is stored;

a first filter disposed upper a surface of the grinding water in the tank; and a suction unit which draws bubbles developing in the tank through the first filter.

(2) The grinding water tank apparatus according to (1) further comprising a cover removable from an upper portion of the tank, to which the first filter is attached.

(3) The grinding water tank apparatus according to (1) further comprising a second filter disposed at a bottom portion of the tank, wherein the suction unit draws the grinding water in the tank through the second filter.

(4) The grinding water tank apparatus according to (3), wherein the suction unit includes a pump which generates suction pressure, and a chamber in which the drawn water is stored, the chamber having capacity larger than capacity of the tank.

(5) A grinding water tank apparatus capable of recycling grinding water used for machining an eyeglass lens, comprising:

a tank in which the grinding water is stored;

a cover removable from an upper portion of the tank; and a pump which draws the grinding water in the tank, which is mounted at a lower portion of the cover through a mount member and disposed under the grinding water in the tank by mounting the cover to the tank.

(6) The grinding water tank apparatus according to (5), further comprising a partition wall which partitions an inside of the tank into a wastewater chamber and a water suction chamber while a passage is provided between the wastewater chamber and the water suction chamber, and wherein the pump is mounted at the lower portion of the cover through the partition wall functioning as the mount member.

(7) A eyeglass lens machining apparatus for machining an eyeglass lens, comprising:

a machining chamber in which a machining tool is provided;

a tank in which grinding water is stored;

a first filter disposed upper a surface of the grinding water in the tank;

a suction unit which draws bubbles developing in the tank through the first filter.

(8) The eyeglass lens machining apparatus according to (7) further comprising a cover removable from an upper portion of the tank, to which the first filter is attached.

(9) The eyeglass lens machining apparatus according to (7) further comprising a second filter disposed at a bottom portion of the tank, wherein the suction unit draws the grinding water in the tank through the second filter.

(10) A eyeglass lens machining apparatus for machining an eyeglass lens, comprising:

a machining chamber in which a machining tool is provided;

a tank in which grinding water is stored;

a cover removable from an upper portion of the tank; and a water supplying unit which supplies the grinding water in the tank to the machining chamber, wherein the water supplying unit includes a pump which draws the grinding water in the tank, which is mounted at a lower portion of the cover through a mount member and disposed under the grinding water in the tank by mounting the cover to the tank.

(11) The eyeglass lens machining apparatus according to (10) further comprising a partition wall which partitions an inside of the tank into a wastewater chamber and a water suction chamber while a passage is provided between the wastewater chamber and the water suction chamber, and wherein the pump is mounted at the lower portion of the cover through the partition wall functioning as the mount member.

DETAILED DESCRIPTION OF PREFERRED EMBODIMENTS

Figure 1:
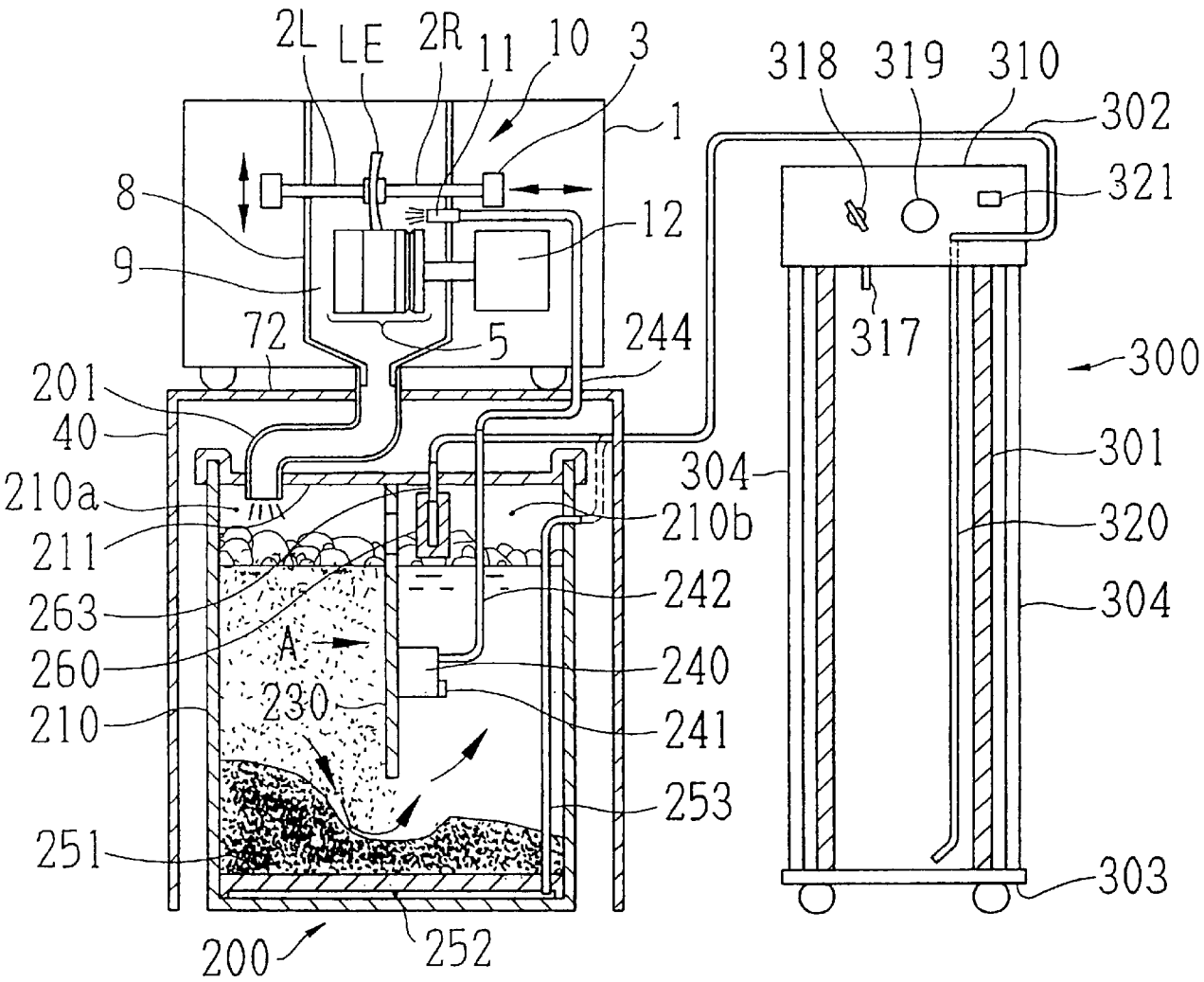
FIG. 1 is a view showing the schematic structure of an entire lens machining apparatus.

An embodiment of the invention will be described hereinbelow with reference to the drawings. FIG. 1 is a view showing the schematic structure of an entire lens machining apparatus. The lens machining apparatus is schematically constituted by: a machining apparatus main unit 1; a table 40 on which the machining apparatus main unit 1 is placed; a tank unit 200 which is to be used for storing grinding water and is disposed in the table 40; and a suction unit 300 having a chamber.

Disposed within a housing of the machining apparatus main unit 1 are two lens rotation shafts 2R, 2L for holding a lens LE to be machined; a carriage section 3 to which the lens rotation shafts 2R, 2L are rotatably attached; and a machining mechanism section 10 including a grindstone 5 attached to a rotary shaft of a motor 12 for machining a peripheral edge of the lens LE. The carriage section 3 is constructed so as to be movable in the direction of an axis around which the lens LE is rotated, as well as to be movable relatively to the grindstone 5. A known configuration described in JP-A-5-212661 (corresponding to U.S. Pat. No. RE. 35,898) filed by the present inventor can be used for the machining apparatus main unit 1, and hence its detailed explanation is omitted.

A machining chamber 9 is formed by a waterproof cover 8 within the machining apparatus main unit 1 so as to surround the lens LE to be held by the lens rotation shafts 2R, 2L and the grind stone 5. A nozzlell to be used for spraying the grinding water extends into the machining chamber 9. A drain hose 201 is connected to a drain hole formed at a position below the waterproof cover 8 and extends to a grinding water storage tank 210 of the tank unit 200.

The tank 210 is cylindrical and has a bottom section and a volume of 20 liters. A cover 211 which substantially seals the inside of the tank 210 from the external space is removably fitted (mounted) to an opening section formed in an upper portion of the tank 210. The drain hose 201 is connected to an upper left portion with respect to the center of the cover 211 shown in FIG. 1, and wastewater delivered through the drain hose 201 is allowed to flow into the tank 210. A partition plate (wall) 230 is secured at a position in the vicinity of the center of the cover 211 shown in FIG. 1 for separating the inside of the tank 210 into two chambers. By means of the partition plate 230, the tank 210 is separated into a wastewater chamber 210*a* on the left side in FIG. 1, and a water suction chamber 210*b* on the right side in FIG. 1. A clearance (an opening) is formed between the bottom surface of the tank 210 and the lower end section of the partition plate 230 and between the side walls of the tank 210 and side end sections of the partition plate 230 for ensuring a passage for flow of the grinding water. The wastewater chamber 210*a* and the water suction chamber 210*b* are linked together.

Figure 2:
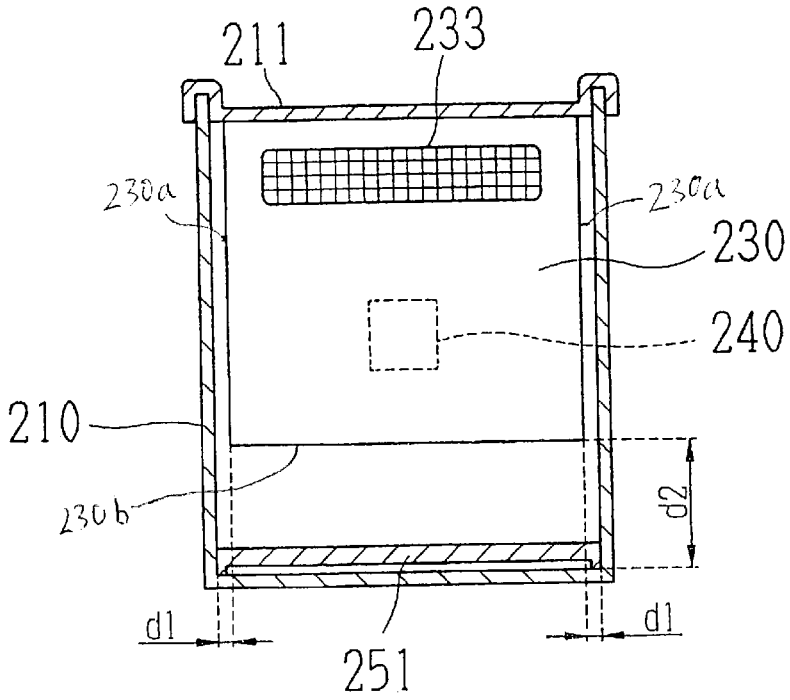
FIG. 2 is an illustration for describing the configuration of a partition plate.

FIG. 2 is an illustration for describing the configuration of the partition plate 230 when viewed from the direction of arrow A shown in FIG. 1. The partition plate 230 is formed such that a small clearance (opening) d1 having a width of 3 to 10 mm is formed vertically between both side walls of the tank 210 and side end sections 230*a* of the partition plate 230. The partition plate 230 is formed such that another clearance (opening) d2 having a width of 30 to 150 mm is formed horizontally between the bottom surface of the tank 210 and the lower end section 230*b* of the partition plate 230. An opening section 233 is formed at a position on the partition plate 230 which is higher than the water surface of the grinding water. Bubbles accumulated on the water surface in the wastewater inlet chamber 210*a* flow to the water suction chamber 210*b* as well. A coarse mesh filter is provided at the opening section 233, to thereby prevent inflow of large pieces of waste to the water suction chamber 210*b*.

A submerged pump 240 to be used for circulating water is secured on the surface of the partition plate 230 facing the water suction chamber 210*a*. The partition plate 230 serves as a stationary member (a mount member) to be used for fixing the submerged pump 240 to a position inside (or below) the cover 211. A water suction port 241 of the submerged pump 240 is located at a position under about one-third the height of water in the tank 210. The water suction port 241 draws water having a smaller amount of suspended waste and prevents suction of precipitated waste. The water drawn by the submerged pump 240 is delivered to the outside of the tank 210 through a hose 242. The water is further delivered to the nozzle 11 of the machining apparatus main unit 1 through a water supply hose 244 connected to the hose 242.

A filtration filter 251 is disposed at the bottom of the tank 210 for facilitating precipitation of waste and separating the waste from water. The filtration filter 251 is a plate having the same cross-sectional profile as that of the tank 210; that is, a disk shape. The waste is accumulated on the filtration filter 251. A hollow section 252 is defined between the bottom surface of the tank 210 and the filtration filter 251. A suction pipe 253 is connected to the hollow section 252. The hollow section 252 is constituted by forming grooves in the lower surface of the filtration filter 251 in a lattice pattern. The suction pipe 253 extends to the outside of the tank 210. A suction hose 302 extending from the suction unit 300 can be connected to a connection port of the suction pipe 253.

Sintered porous plastic formed by sintering plastic beads is employed as the filtration filter 251, since the porous plastic is lightweight and has superior durability and machinability. Here, the sintered porous plastic is formed from any of the following raw materials; that is, polyethylene, polypropylene, and ethylene-vinyl acetate copolymer. A pore of the filtration filter 251 has a diameter about 15 $\mu$m. The present inventor has ascertained filtrating states through tests by use of a filtration filter having a pore diameter of 15 $\mu$m and a filtration filter having a pore diameter of 70 $\mu$m. The test results reveal that the water that has been filtrated by means of the filtration filter having a pore diameter of 70 $\mu$m assumes a whitish turbidity, and a low filtration accuracy is achieved. A result of further continued filtrating operation also revealed that minute waste has caused clogging in the filter, thereby deteriorating a filtration speed. In contrast, the tests revealed that the water that has been filtrated by means of the filtration filter having a pore diameter of 15 $\mu$m is transparent, and continued filtration operation has less effect on the filtration speed.

A cylindrical air filter 260 is provided in the space defined between the water surface of the water stored in the tank 210 and the cover 211. The air filter 260 is also formed from the same sintered porous plastic as that used to form the filtration filter 251. The inside of the air filter 260 is a sealed hollow section. A suction pipe 263 connected to the hollow section is fixed to the cover 211, and the air filter 260 is fixed so as to be suspended from the cover 211. The suction hose 302 of the suction unit 300 can be connected to the connection port of the suction pipe 263 upwardly extending from the cover 211. The suction unit 300 is shared between the filtration filter 251 and the air filter 260.

The structure of the suction unit 300 will be described. The suction unit 300 includes the tank 301 having a chamber formed therein. The tank 301 is formed from cylindrical transparent acrylic resin. The chamber of the tank 301 has a volume of 22 liters and is larger in volume than the tank 210. The tank 301 can collect the grinding water stored in the tank 210 by one operation. A pump unit 310 having a vacuum pump or the like is mounted on top of the tank 301. The pump unit 310 is mounted by four support poles 304 extending from a bottom plate 303.

Figure 3:
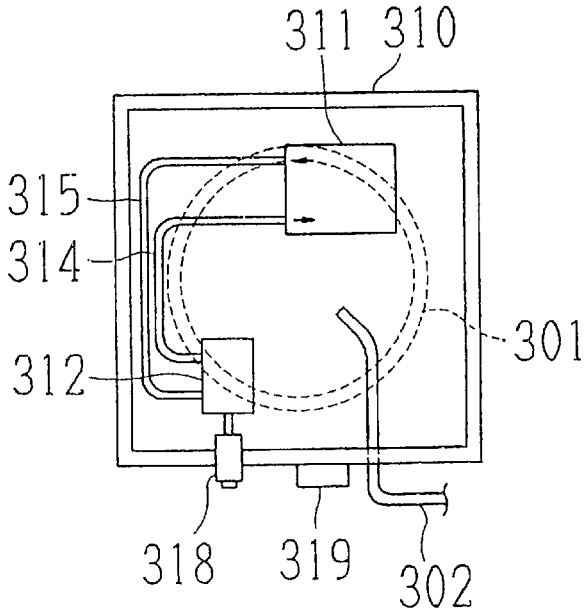
FIG. 3 is an illustration of inside of a pump unit provided in a suction unit when viewed from above.

FIG. 3 is an illustration of the inside of the pump unit 310 when viewed from above. The pump unit 310 includes a vacuum pump 311 and a valve 312 for switching between suction of air/delivery of air to be performed by the vacuum pump 311. A suction tube 314 and an air delivery tube 315, both extending from the vacuum pump 311, are connected to the valve 312. A pipe 317 extends from a lower portion of the valve 312 to the inside of the tank 301. Reference numeral 318 designates an operation knob to be used for switching a passage of the valve 312. By means of the operation knob 318, the passage connected to the pipe 317 is selectively switched between the tube 314 and the tube 315. Reference numeral 319 designates a timer for setting a drive time of the vacuum pump 311. The suction hose 302 connected to the tank 210 is connected to a hose 320 provided in the tank 301. The end of the hose 320 extends to the bottom of the inside of the tank 301. Reference numeral 321 designates a power switch of the vacuum pump 311.

According to such a configuration, when machining of a peripheral edge of the lens LE is started by the machining apparatus main unit 1, the submerged pump 240 is driven by the control signal output from the control section of the machining apparatus main unit 1. The grinding water pumped from the water suction chamber 210*b* is sprayed from the nozzle 11. The thus-sprayed grinding water and resultant waste stemming from machining are received by the waterproof cover 8, and the wastewater (the grinding water and the waste) are discharged to the wastewater chamber 210*a* of the tank 210 through the drain hose 201.

Waste of micron size or smaller stemming from machining of the plastic lens is not dissolved by water and produces bubbles at the time of discharge. An air layer is formed on the surface of the grindstone 5 as a result of high-speed rotation, and air and water are mixed together by addition of grinding water for cooling purpose to the air layer. Hence, air and water are simultaneously discharged from the drain hose 201. The waste that is not dissolved in air or water forms bubbles. Once bubbles have been formed, large particles adhere to the bubbles, thereby rendering the bubbles unbreakable. When a number of plastic lenses are machined, the tank is filled with such bubbles.

For extinguishing the bubbles developed in the tank 210, the suction hose 302 extending from the suction unit 300 is connected to the suction pipe 263 connected to the air filter 260, and the vacuum pump 311 is started. The passage of the pump 311 connected to the pipe 317 is set to the tube 314 of the suction passage by means of the operation knob 318. The inside of the chamber of the tank 301 assumes negative pressure by means of operation of the vacuum pump 311, and a suction pressure is exerted on the hollow section of the air filter 260 through the hose 320, the suction hose 302 and the suction pipe 263. As a result, air and bubbles existing in the tank 210 are drawn through the air filter 260. The waste included in the bubbles is filtrated by the air filter 260 and separated from moisture. The thus-separated moisture flows through the hollow section of the air filter 260 in conjunction with air and is discharged to the tank 301 through the suction pipe 263 and the hose 320 and is stored in the chamber. As a result, the bubbles developing in the tank 210 are extinguished, thereby inhibiting the quantity of bubbles. When the number of lenses to be machined per day in an optician's shop is not high, the vacuum pump 311 is activated after business hours. However, when the number of lenses to be machined is high, the vacuum pump 311 may be activated in conjunction with machining of lenses or operation of the submerged pump 240.

The waste discharged into the tank 210 is heavier than water and hence is precipitated. The wastewater chamber 210a and the water suction chamber 210*b* are separated by the partition plate 230. Hence, the waste mixed in the wastewater encounters difficulty in passing around the water suction chamber 210*b*. Hence, most of the waste accumulates on the inner bottom of the tank 210. Since the water suction port 241 of the submerged pump 240 is located at a position above the lower portion of the partition plate 230, the waste encounters difficulty in reaching the water suction port 241, thereby inhibiting mixing of the waste into the grinding water to be supplied to the nozzle 11.

When a large number of lenses are machined, the amount of precipitated waste becomes larger, and the clearance existing below the partition plate 230 becomes buried with the waste. In this state, the proportion of waste reaching the water suction port 241 of the submerged pump 240 becomes larger, and the precipitated waste must be eliminated at this time. Though, it depends on the height of the location of the water suction port 241, if waste of five to six liters can be precipitated, 200 to 300 lenses can be machined. Since the grinding water flows through the clearance formed on both sides of the partition plate 230, overflow of the grinding water from the wastewater chamber 210*a* is prevented even when the clearance existing below the partition plate 230 is buried with the waste.

When the waste is to be cleaned from the inside of the tank 210, the suction hose 302 extending from the suction unit 300 is connected to the connection port of the suction pipe 253, and the vacuum pump 311 is activated. When the vacuum pump 311 has been activated, suction pressure is exerted on the hollow section 252 formed below the filtration filter 251, and the grinding water in the tank 210 is drawn through the filtration filter 251. The grinding water is discharged to the chamber of the tank 301 through the suction pipe 253 and the suction hose 302. When the vacuum pump 311 is continuously activated, moisture contained in the waste is finally drawn through suction. When the amount of moisture contained in the waste is sufficiently reduced, the waste becomes cracked and air is directly drawn by suction. The operation time of the vacuum pump 303 can be set beforehand by means of the timer 319.

The waste existing in the tank 210 is solidified after having been separated from water by means of the filtration filter 251. Hence, the waste becomes easy to take out. At the time of cleaning of the inside of the tank 210, the cover 211 is removed. Since the submerged pump 240 is secured on the cover 211 through the partition plate 230, consumption of labor required to take out the pump is omitted, thereby facilitating work. Moreover, the air filter 260 is attached to the cover 211, and hence cleaning operation is easy. The solidified waste is thrown into a plastic bag and can be disposed of as industrial waste by a waste-treatment company.

The water accumulated in the tank 301 of the suction unit 300 is sufficiently filtrated by the filtration filter 251 and the air filter 260. Hence, the water can be returned to the tank 210 for recycling. When the water is discharged from the tank 301, a switch to the passage connected to the vacuum pump 311 is effected by the operation knob 318, thereby delivering air to the chamber of the tank 301. When the inside of the chamber is pressurized, the water is delivered by way of the hoses 320 and 302.

As has been described, according to the invention, labor required for replacing grinding water and cleaning a tank is lessened, thereby facilitating maintenance operation. Further, combined use of a bubble suction mechanism and a suction mechanism for filtrating waste yields an economical advantage.

What is claimed is:

1. A grinding water tank apparatus capable of recycling grinding water used for machining an eyeglass lens, comprising:

a tank in which the grinding water is stored;

a first filter disposed upper a surface of the grinding water in the tank; and a suction unit which draws bubbles developing in the tank through the first filter.

2. The grinding water tank apparatus according to claim 1 further comprising a cover removable from an upper portion of the tank, to which the first filter is attached.

3. The grinding water tank apparatus according to claim 1 further comprising a second filter disposed at a bottom portion of the tank, wherein the suction unit draws the grinding water in the tank through the second filter.

4. The grinding water tank apparatus according to claim 3, wherein the suction unit includes a pump which generates suction pressure, and a chamber in which the drawn water is stored, the chamber having capacity larger than capacity of the tank.

5. A grinding water tank apparatus capable of recycling grinding water used for machining an eyeglass lens, comprising:

a tank in which the grinding water is stored;

a cover removable from an upper portion of the tank; and a pump which draws the grinding water in the tank, which is mounted at a lower portion of the cover through a mount member and disposed under the grinding water in the tank by mounting the cover to the tank.

6. The grinding water tank apparatus according to claim 5, further comprising a partition wall which partitions an inside of the tank into a wastewater chamber and a water suction chamber while a passage is provided between the wastewater chamber and the water suction chamber, and wherein the pump is mounted at the lower portion of the cover through the partition wall functioning as the mount member.

7. A eyeglass lens machining apparatus for machining an eyeglass lens, comprising:

a machining chamber in which a machining tool is provided;

a tank in which grinding water is stored;

a first filter disposed upper a surface of the grinding water in the tank;

a suction unit which draws bubbles developing in the tank through the first filter.

8. The eyeglass lens machining apparatus according to claim 7 further comprising a cover removable from an upper portion of the tank, to which the first filter is attached.

9. The eyeglass lens machining apparatus according to claim 7 further comprising a second filter disposed at a bottom portion of the tank, wherein the suction unit draws the grinding water in the tank through the second filter.

10. A eyeglass lens machining apparatus for machining an eyeglass lens, comprising:

a machining chamber in which a machining tool is provided;

a tank in which grinding water is stored;

a cover removable from an upper portion of the tank; and a water supplying unit which supplies the grinding water in the tank to the machining chamber, wherein the water supplying unit includes a pump which draws the grinding water in the tank, which is mounted at a lower portion of the cover through a mount member and disposed under the grinding water in the tank by mounting the cover to the tank.

11. The eyeglass lens machining apparatus according to claim 10 further comprising a partition wall which partitions an inside of the tank into a wastewater chamber and a water suction chamber while a passage is provided between the wastewater chamber and the water suction chamber, and wherein the pump is mounted at the lower portion of the cover through the partition wall functioning as the mount member.

* * * * *